US005968391A

United States Patent [19]

Deo et al.

[11] Patent Number: 5,968,391

[45] Date of Patent: Oct. 19, 1999

[54] MODULAR RADIANT HEATING UNIT

[75] Inventors: Subhash R. Deo, Fayette, Ala.; Simon P. Griffiths, Columbus, Miss.

[73] Assignee: Emerson Electric Company, St. Louis, Mo.

[21] Appl. No.: 09/073,291

[22] Filed: May 6, 1998

[51] Int. Cl.[6] ..... H05B 3/68; F24C 15/10

[52] U.S. Cl. ..... 219/460.1; 219/452.11; 126/214 A

[58] Field of Search ..... 219/446.1, 448.11, 219/451.1, 452.11, 455.11, 456.1, 460.1, 461.1, 463.1, 465.1, 466.1, 467.1, 468.1, 468.2; 126/211, 217, 214 A

[56] References Cited

U.S. PATENT DOCUMENTS

| | | | |
|---|---|---|---|
| 3,346,721 | 10/1967 | Bassett, Jr. | 219/460.1 |
| 3,501,621 | 3/1970 | Pansing et al. | 219/460.1 |
| 3,612,827 | 10/1971 | Dills | 219/460.1 |
| 3,646,321 | 2/1972 | Siegla | 219/460.1 |
| 3,686,477 | 8/1972 | Dills et al. | 219/465.1 |
| 3,733,462 | 5/1973 | Bouchard et al. | 219/451.1 |
| 3,833,793 | 9/1974 | McWilliams et al. | 219/460.1 |
| 4,414,465 | 11/1983 | Newton et al. | 219/448.11 |
| 5,000,157 | 3/1991 | Harper . | |
| 5,780,817 | 7/1998 | Eckman et al. | 219/460.1 |

*Primary Examiner*—Teresa Walberg
*Assistant Examiner*—Sam Paik
*Attorney, Agent, or Firm*—Polster, Lieder, Woodruff & Lucchesi, L.C.

[57] ABSTRACT

A modular radiant heater unit (10) is for use in a stove top (RT) designed for installation of a tubular coil type heating unit (C). The heater can either use a coil (12), or a ribbon heating element (14). The element rests upon a cake (20) of an insulation material fitted within a pan (16) sized to be installed in an opening (6) in the stove type in which a coil type heating unit is normally installed. The heating unit has an electrical connector (24) adapted to readily connect with the electrical connector installed in the stove top. A radiant glass cover (30), sized to fit over the heater unit, is fitted over the pan and held in place by an annular ring (34) which fits about the circumference of the pan and a shield (38) which covers a gap (6) between the heater unit and stove top. Utensils for cooking food are placed upon the glass top. The heater control (K) normally used to control the temperature of a tubular, coil heater, is now used to control the temperature of the radiant heater unit.

24 Claims, 4 Drawing Sheets

MODULAR RADIANT HEATING UNIT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to electric heating units of the type used in range tops or stove tops, and more particularly, to an integrated radiant heating unit which can be used as a modular heating element equivalent of a conventional tubular heating unit, as well as for incorporation in new cooking appliance designs.

Conventional electric stoves are equipped with one or more (usually four) tubular, coil top cooking units housed in a maintop. Some of the units are designed for one wattage rating, and other of the units have a different rating. The units are independent of each other with each unit being a plug-in unit. That is, each unit can be separately removed and replaced without effecting any of the remaining units. The portion of the maintop about each heating unit is typically a raised surface so pots and pans placed on a cooking unit are supported slightly above the range top surface.

Radiant heating elements are also known in the art. Some stoves are equipped with these types of units rather than the tubular coil top units discussed above. Stoves employing radiant heating units are glass top units. That is, the heating units are supported beneath a sheet of glass and heat produced by a unit radiates onto the bottom of the utensil placed on top of the glass. The glass typically 4 mm. thick and the glass top is, for example, a 20"×30"(51cm×76cm) sheet. A cooking utensil placed on the top of the glass (which is generally level with the rest of the range top) is heated by the heat transferred through the glass to the bottom of the utensil. A specific disadvantage of this arrangement is that the cooktop glass, if and when broken, needs to be replaced as a whole unit. Individual radiant elements also have to be mounted specially and may require special skills or a service call from a professional to replace them. In addition, there are other heating units which are built with a glass cover above a tubular, coil type heater. However, such heaters require a relatively long time to heat up, and their operation is relatively inefficient.

It would be advantageous to have a modular radiant heating unit that can be handled "independent" of the other units. It is also very desirable to have a unit whose operation is energy efficient at all levels of power input settings on the controls.

BRIEF SUMMARY OF THE INVENTION

Among the several objects of the present invention may be noted the provision of a modular radiant heater unit for use in range tops normally employing tubular coil type heating units;

the provision of such a radiant heater unit which is usable as a replacement part for replacing tubular coil type heating units, or as original equipment;

the provision of such a radiant heater unit which is a plug-in, self-contained unit sized and configured to be a "drop-in" replacement requiring little, if any, modification to the stove in which the radiant heater unit is substituted;

the provision of such a modular radiant heater unit which is a glass top unit but which is compatible with the surface contour of the range top with which it is used so to provide a surface flush with a raised portion of the range top;

the provision of such a radiant heater unit to be available in different sizes and wattages for ease of replacement with a similar tubular coil type unit;

the provision of such a radiant heater unit in which from one to all of the tubular coil type units are replaceable with a corresponding radiant heater unit so that a range top may include a mix of coil type units in which cooking utensils are set immediately on top of the heating element, and radiant heating units for which the cooking utensil is rested upon a glass top portion of the unit; and, the provision of such a radiant heater which is a low cost, reliable unit that readily cooks food in a utensil placed upon the heater unit in a timely and energy efficient manner.

In accordance with the invention, generally stated, a modular radiant heater unit is for use in a stove top designed normally for installation of coil type heating unit. The heater can either use an open coil, or a ribbon heating element. The element rests upon a cake of an insulation material fitted within a pan sized to be installed in an opening in the stove top in which a coil type heating unit is normally installed. The heating unit has an electrical connector adapted to readily connect with an electrical connector installed in the stove top. A glass cover, sized to fit over the heater unit, is fitted over the pan and is sealed in place. The remainder of the configuration is customized to meet the requirements unique to each application, such as, mounting the unit in a particular appliance, and electrically connecting the unit to the appliance. Utensils for cooking food are placed upon the glass top. The heater control normally used to control the temperature of a tubular coil heater is now used to control the temperature of the radiant heater unit. Other objects and features will be in part apparent and in part pointed out hereinafter.

BRIEF DESCRIPTION OF THE SEVERAL VIEWS OF THE DRAWINGS

In the drawings,

FIGS. 1 and 2 represent a prior art range top using coil heating units wherein FIG. 1 is a top plan view of the range top, and FIG. 2 is a sectional view of the range top taken along lines 2—2 in FIG. 1;

FIGS. 3 and 4 similarly represent a prior art range top using radiant heater units wherein FIG. 3 is a top plan view of the range top, and FIG. 4 is a sectional view of the range top taken along lines 4—4 in FIG. 3;

Corresponding reference characters indicate corresponding parts throughout the drawings.

DETAILED DESCRIPTION OF THE INVENTION

Figure 1:
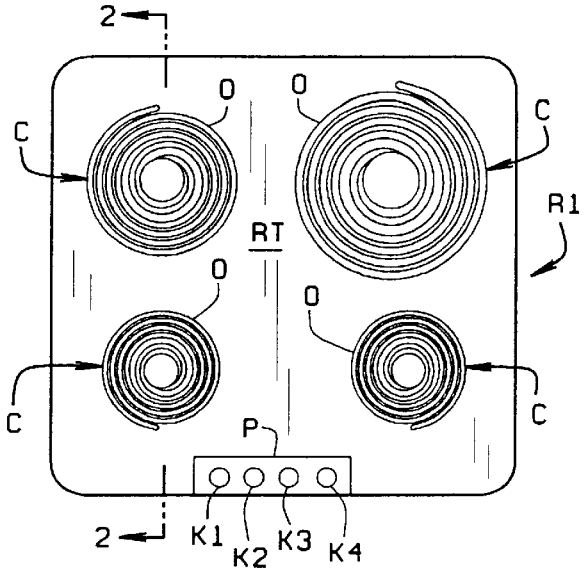
FIG. 1 PRIOR ART
Figure 2:
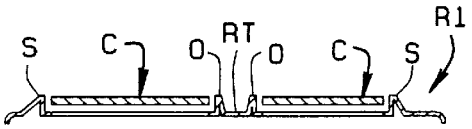
FIG. 2 PRIOR ART

Referring to the drawings, a range R1 is shown in FIGS. 1 and 2 to have a range top RT in which a plurality of openings (four) O are formed. A tubular coil type heating unit C is installed in each opening. A knob K1–K4 on a control panel P is used to control the temperature of a respective heating unit so to cook food in a utensil (not shown) placed on a respective heating unit. In FIG. 2, it is seen that the range top has a raised surface S about each opening O, so a utensil placed upon a cooking unit is raised above the range top surface. Each cooking unit C is a plug in unit that has an electrical connector which seats with a mating connector located at the base of the opening beneath the range top. When a cooking unit is replaced, all that is necessary is to disconnect the unit, remove it through the opening, and drop the replacement unit into place.

Figure 3:
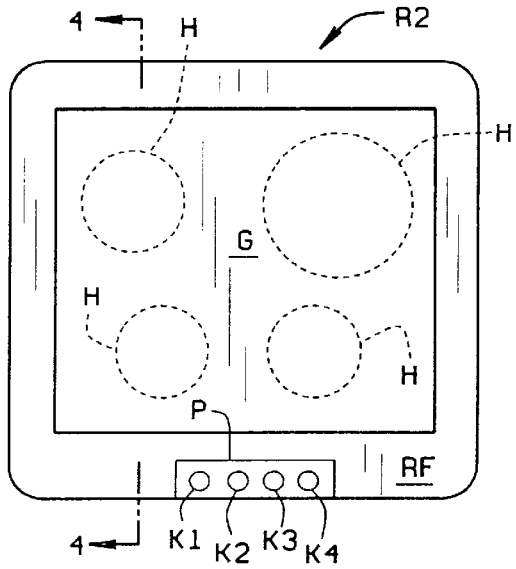
FIG. 3 PRIOR ART
Figure 4:
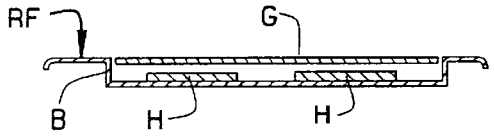
FIG. 4 PRIOR ART

In FIGS. 3 and 4, a second range R2 has a range top RF in which a rectangular recess B is formed. Radiant heating elements H are installed in the recess which is covered by a glass top heating surface G. Each energized heating element radiates heat energy through the glass top upon which a utensil is placed. As shown in FIG. 4, the surface formed by the range top and glass top are essentially co-planar.

Figure 5A:
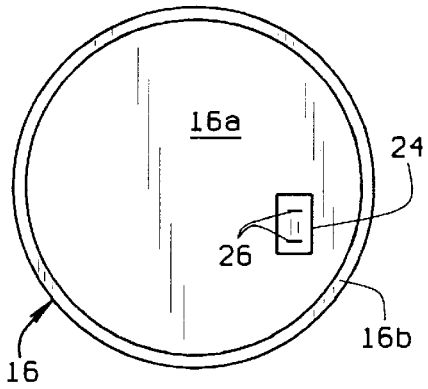
FIG. 5A and FIG. 5B are respective bottom and top plan views of a modular radiant heater unit for use with the range shown in FIG. 1, the view of FIG. 5B being with the glass top removed.
Figure 5B:
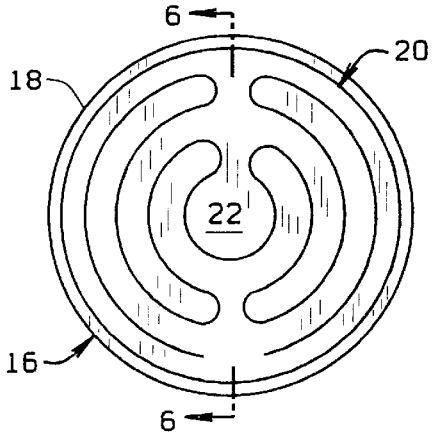
Figure 6:
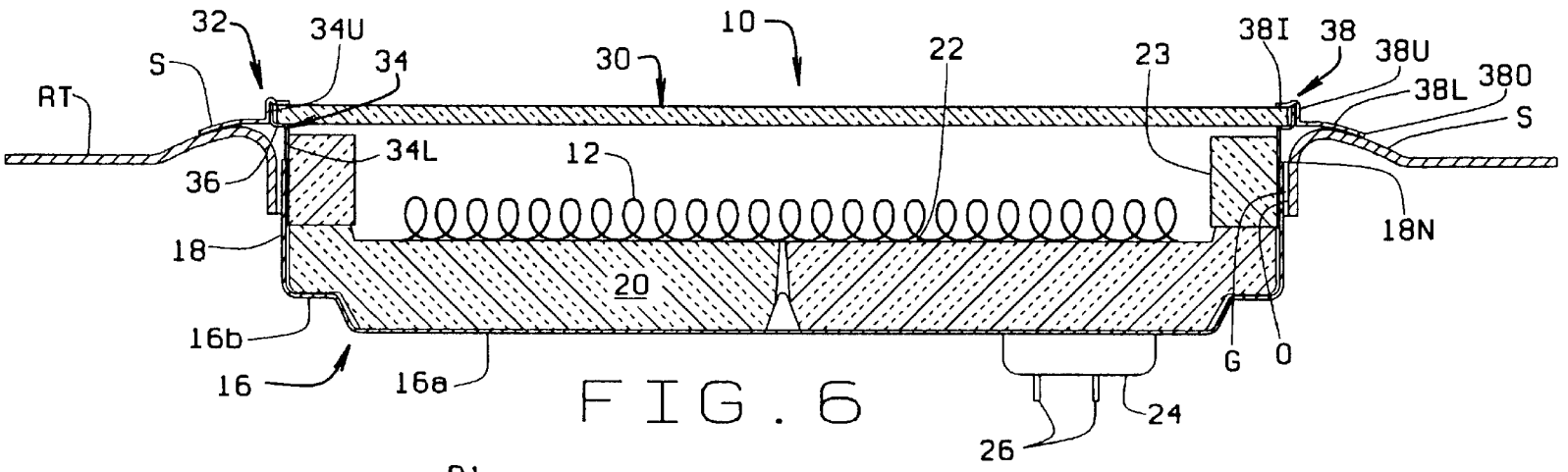
FIG. 6 is a sectional view of the heater, with the glass top installed, taken along line 6—6 in FIG. 5B.
Figure 9A:
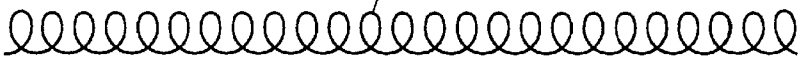
FIG. 9A is a coil heating element used in the radiant heating unit.
Figure 9B:
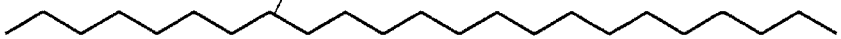
FIG. 9B is a ribbon heating element used in the unit; and, FIG. 10 is a sectional view of the heating unit with a thermostat installed against the base of the modular unit.
Figure 8:
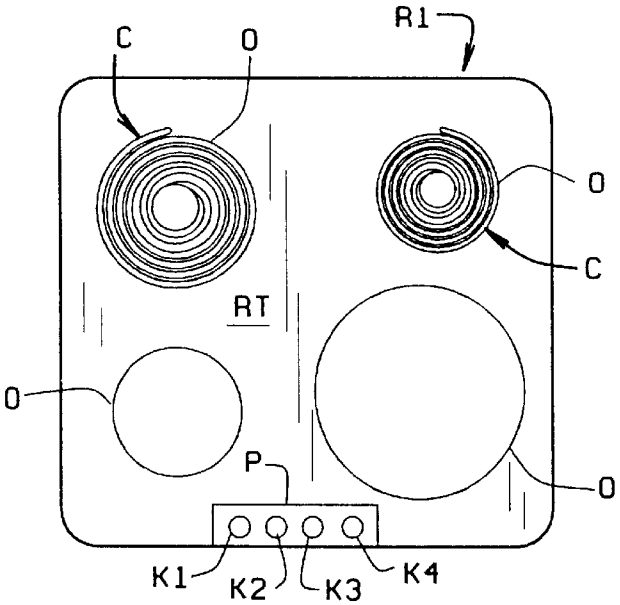
FIG. 8 is a plan view of a hybrid range top utilizing both coil and radiant heater units.

In accordance with the present invention, a radiant heater unit 10 similar to a radiant heater unit H is for use in a stove top RT designed for installation of a coil type heating unit C. Unit 10 can be used as a replacement for a tubular coil-type heating unit, or unit 10 can be installed as original equipment. Thus, as shown in FIG. 8, one or more heating units for range RT could be heating units 10, with the other units being the conventional tubular coil type units C. As shown in FIG. 6, unit 10 first includes a radiant heating element 12. As shown in FIGS. 6 and 9A, heating element 12 is a coil type heating element. As shown in FIG. 9B, the heating element is a ribbon type heating element 14. Either type of heater is laid out in a pattern most appropriate for the required heating performance. It will be understood that the pattern shown in FIG. 5B is illustrative only and that other patterns can be used without departing from the scope of the invention.

A pan 16 of unit 10 is sized to fit within opening O in the range top. As shown in FIGS. 5A, 5B, 6, and 7, pan 16 has a shallow base portion 16*a*, and a larger diameter pan portion 16*b* defined by a circumferential sidewall 18. A cake 20 of an insulation material is installed in pan 16. The cake has an upper surface 22 on which radiant heating element 12 or 14 is supported. An insulation ring 23 rests along the circumferential boundary of insulation cake 20, fitting well within sidewall 18 of pan 16.

An electrical connector 24 has terminals 26 one end of each of which attach to a respective end of the radiant heating element 12 or 14. The terminals 26 connect with an electrical connector (not shown) installed in the range stove top and to which a coil type heating unit C is normally connected. When radiant heating unit 10 is installed in opening O, terminals 26 of connector 24 are connected to the mating connector of the appliance.

A heat conductive cover or glass top 30 is sized to fit over radiant heating element 12 or 14, and as shown in the drawings, is in a spaced relation above the heating element. Since opening O in the range top is a circular opening, pan 16 and glass top 30 are also both circular in shape. Within the scope of the invention, modular radiant heating unit 10 can also be made for use with openings O which have other shapes. Specifically, unit 10 can be made for use in range tops having opening shapes which are, among others, oval or oblong, rectangular and square. The final shape and exact dimensions of a heating unit 10 are determined by the requirements of the particular cooking appliance with which the unit is used. Different configurations, to fit into various existing appliances, have been built for use in qualification testing and comparative performance characterizations.

With respect to the construction shown in the drawings, radiant heating unit 10 includes a means 32 securing the glass top about the opening. Means 32 includes an annular ring 34 sized to fit over rim 18N of pan sidewall 18 for the base of a ring 34 to be supported on the rim. Ring 34 has an upper section 34U and a lower section 34L. Lower section 34L of the ring has a height corresponding to the height by which sidewall 23 of the insulation material extends above the top of pan rim 18N. This lower ring section fits about sidewall 23 when cake 20 of the insulation material is in place in pan 16. Upper section 34U of the ring has a height corresponding to the thickness of glass top 30. An annular shoulder 36 is formed at the junction between the upper and lower ring sections. The width of the shoulder corresponds to the distance by which the size of glass top 30 exceeds the size of pan 18 for an outer circumferential portion of the cover to be supported by the annular ring.

Figure 7:
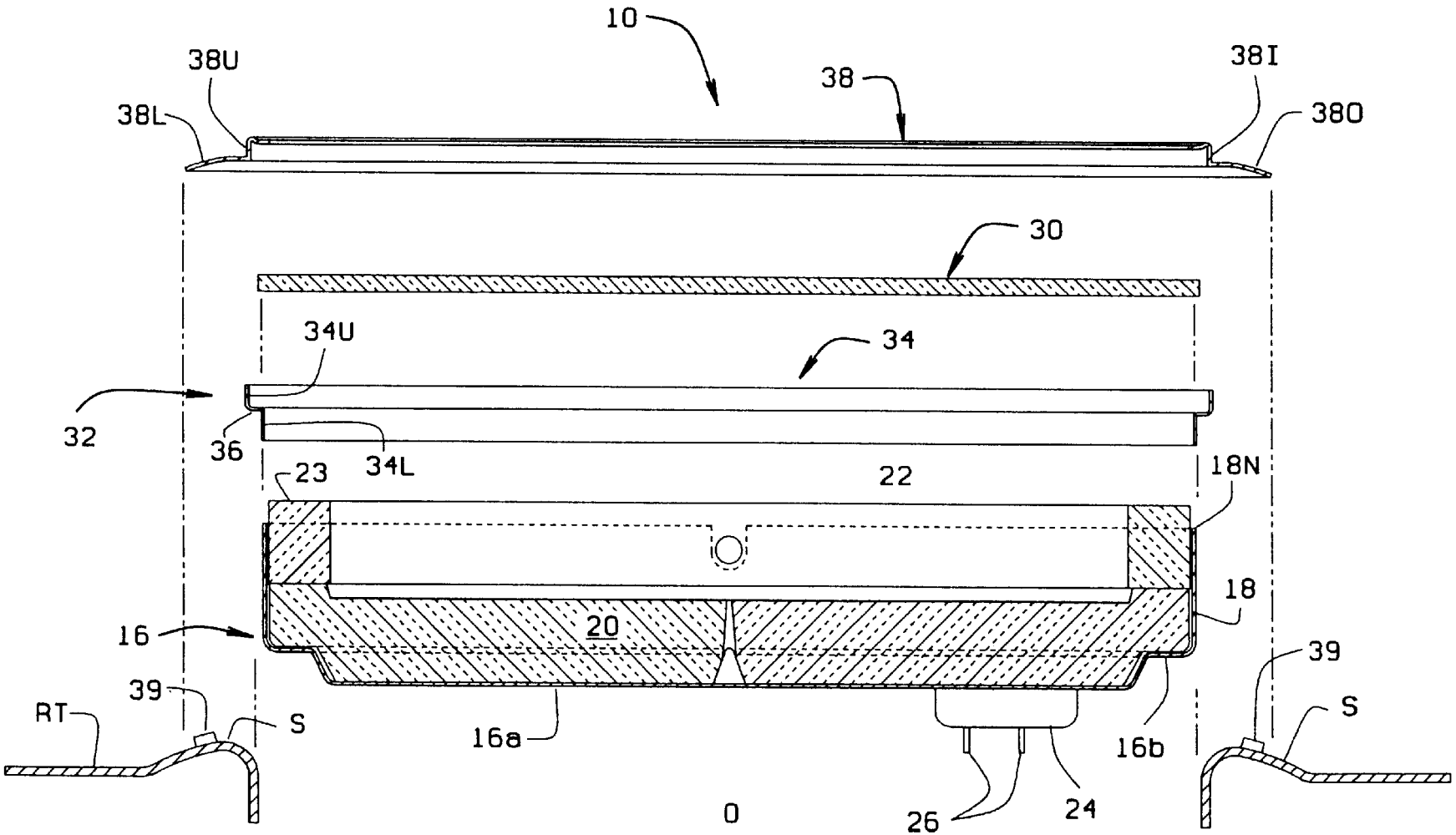
FIG. 7 is an exploded view of the radiant heater.

Means 32 further includes an annular shield 38. The shield has an upper end 38U the height of which corresponds to the thickness of the glass top. An inner end 38I of this upper section extends over an outer margin of the glass top circumferentially about the glass top. The shield further includes a lower outwardly flaring section 38L. An outer end 38O of section 38L extends over a gap G extending circumferentially about opening O and formed between the opening and pan 16. Alternately, an annular collar (not shown) could be used which would fit about the glass top and extend out over the sidewall of the pan so to rest upon raised surface S adjacent the opening. To install unit 10, a heating unit C is first removed. Heating unit 10 with glass top 30 in place is then installed in opening O. After the heating unit is in place, shield 38 is installed. As shown in FIG. 7, a bead 39 of a sealant material such as a RTV sealant material is deposited on raised surface S of the cooktop to form a seal with shield 38 thus to seal between opening O and the radiant heating unit.

Figure 10:
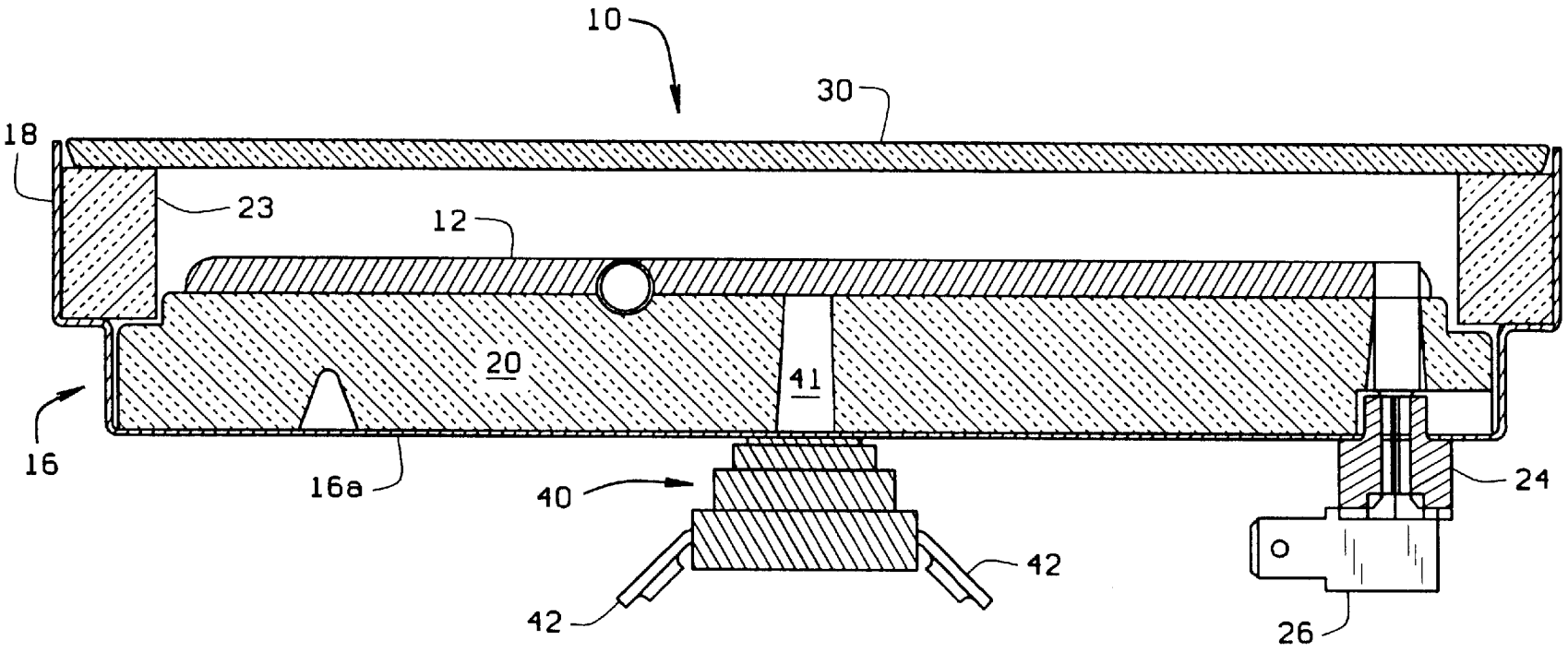

As shown in FIG. 10, a temperature sensor 40 is secured to the base of heating unit 10. Sensor 40 consists of a snap-type temperature switch located under a central opening 41 formed in insulating material 20. The sensor is directly effected by the temperature in cavity formed between the heating unit 10 and glass top 30, and acts to cut off current flow to radiant heating element 12 or 14 when the sensed temperature reaches a predetermined temperature. For this purpose, temperature sensor 40 has electrical contacts 42 by which the sensor is connected in a control circuit for the heating unit. Operation of the temperature sensor is limited to only when the appropriate control K1–K4 for that unit is at its full on position. At that control setting, radiant heating unit 10 cycles on and off as a function of the sensed cavity temperature.

What has been described is a low cost, reliable modular radiant heater unit used in range tops normally employing coil type heating units, the unit being usable either as a replacement part or as original equipment. The unit is a plug-in, self-contained drop-in part requiring little modification to the stove for its use. Although a glass top element, the unit is designed to be compatible with the raised surface contour of the range top and provide a suitable cooking surface. The unit is available in different sizes and wattages for ease of replacement with coil type units, so units can replace one or all of the coil type units providing a range top which may include a mix of both coil type and radiant heater units.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

We claim:

1. A modular radiant heating unit for use in an electric range with a maintop or in an electric cooktop, both of which are normally equipped with conventional tubular heaters, the modular radiant heater unit comprising:

a radiant heating element;

a pan having a circumferential rim and sized to fit within an opening formed in said range top and in which a tubular coil type heating unit is normally installed, said pan supporting said radiant heating element;

insulation material fitting within said pan and supporting said radiant heating element thereon, said insulation material having a sidewall extending circumferentially about said pan and extending above said rim;

an electrical connector attached to said radiant heating element and adapted to connect with an electrical connector installed in said stove top, and used to supply electrical current to said heating element;

a heat conductive cover fitting over said pan in a spaced relation with said radiant heating element, a surface area of said stove top about said opening being raised above a remaining portion of said stove top and said cover being larger than said opening so to cover said opening and fit over at least a portion of said raised area;

means securing said cover about said opening for heat generated by said heating element to be radiated at said cover and conducted through said cover to heat a utensil placed upon said radiant heating unit, said means enclosing a gap formed between said pan and said opening; and, an annular ring fitting over said rim for a base of said ring to be supported by said rim, said ring having an upper section and a lower section, the lower section of said ring having a height corresponding to the height which said insulation material sidewall extends above the top of said rim, and said lower section fitting about said insulation material sidewall.

2. The radiant heating unit of claim 1 wherein said opening is a circular opening and said pan and said cover have a corresponding circular shape.

3. The radiant heating unit of claim 1 wherein said opening is oval in shape and said pan and said cover have a corresponding oval shape.

4. The radiant heating unit of claim 1 wherein said opening is a rectangular opening and said pan and said cover have a corresponding rectangular shape.

5. The radiant heating unit of claim 1 wherein said opening is square and said pan and said cover have a corresponding square shape.

6. The radiant heating unit of claim 1 wherein the upper section of said ring has a height corresponding to the thickness of said cover, an annular shoulder being formed at a junction between said upper and lower ring sections, the width of said shoulder corresponding to the distance by which the size of said cover exceeds the size of said pan for an outer circumferential portion of said cover to be supported by said ring.

7. The radiant heating unit of claim 6 wherein said means securing said cover about said opening further includes an annular shield one end of which extends over the outer margin of said cover circumferentially about said cover, and another end of which extends over the gap extending circumferentially about said opening and formed between said opening and said pan.

8. The radiant heating unit of claim 7 further including a sealant material deposited on said raised portion of said range top about said opening, said sealant material forming a seal between said opening and said radiant heating unit.

9. The radiant heating unit of claim 1 wherein said radiant heating element is a coil type heating element.

10. The radiant heating unit of claim 1 wherein said radiant heating element is a ribbon type heating element.

11. The radiant heating unit of claim 1 further including a temperature sensor sensing the temperature of the heating unit and cutting off flow of current to the heating element when the sensed temperature reaches a predetermined temperature.

12. A radiant heater unit for use in a stove top designed for installation of a tubular coil type heating unit comprising:

a radiant heating element;

a pan having a circumferential rim and sized to fit within an opening in said stove top in which said coil type heating unit is normally installed, said radiant heating element being installed in said pan;

insulation material installed in a base portion of said pan and having an upper surface on which said radiant heating element is supported, said insulation material having a sidewall extending circumferentially about said pan and extending above said rim;

an electrical connector attached to said radiant heating element and adapted to connect with an electrical connector installed in said stove top and to which a coil type heating is normally connected;

a heat conductive cover sized to fit over said radiant heating element in a spaced relation therewith, a surface area of said stove top about said opening being raised above a remaining portion of said stove top, said cover fitting over said rim of said pan and said cover being larger than said opening so to cover said opening and to fit over at least a portion of said raised area; and, means securing said cover about said opening for heat generated by said heating element to be radiated at said cover and conducted through said cover to heat a utensil placed upon said radiant heating unit, said means including a ring fitting about said cover and a sidewall of said pan formed by said rim, said ring having an upper section and a lower section, the lower section of said ring having a height corresponding to the height which the sidewall of said insulation material extends above the top of said rim, said lower section fitting about said insulation material sidewall when in place, and the upper section of said ring having a height corresponding to the thickness of said cover, an annular shoulder being formed at the junction between said upper and lower ring sections, the width of said shoulder corresponding to the distance by which the size of said cover exceeds the size of said pan for an outer circumferential portion of said cover to be supported by said ring.

13. The radiant heater unit of claim 12 wherein said opening is a circular opening and said pan and said cover have a corresponding circular shape.

14. The radiant heater unit of claim 12 wherein said opening is oval in shape and said pan and said cover have a corresponding oval shape.

15. The radiant heater unit of claim 12 wherein said opening is a rectangular opening and said pan and said cover have a corresponding rectangular shape.

16. The radiant heater unit of claim 12 wherein said opening is square and said pan and said cover have a corresponding square shape.

17. The radiant heating unit of claim 12 wherein said means securing said cover about said opening further includes an annular shield one end of which extends over the outer margin of said cover circumferentially about said cover, and another end of which extends over a gap extending circumferentially about said opening and formed between said opening and said pan.

18. The radiant heating unit of claim 17 further including a sealant material deposited on said raised portion of said range top about said opening, said sealant material forming a seal between said opening and said radiant heating unit.

19. The radiant heating unit of claim 12 wherein said radiant heating element is a coil type heating element.

20. The radiant heating unit of claim 12 wherein said radiant heating element is a ribbon.

21. The radiant heating unit of claim 12 further including a temperature sensor sensing the heating unit temperature and terminating current flow to the heating element when the sensed temperature reaches predetermined temperature.

22. A replacement modular heating unit for installation in a cooktop as a replacement for a tubular-type heating unit normally installed in an opening therein comprising:

a radiant heating element connected to a source of electrical energy;

a pan fitting in said opening and insulation material fitting in said pan, said heating element being supported on a surface of said insulation material, said pan having a circumferential rim thereabout and said insulation material having a sidewall extending above said rim;

a heat conductive cover fitting over said pan, heat generated by said heating element being radiated at said cover and conducted through said cover to heat a utensil placed thereon, a surface area of said cooktop about said opening being raised above a remaining portion of the cooktop and said cover being larger than said opening to cover said opening and fit over at least a portion of said raised area; and, an annular ring securing said cover about said opening, an inner margin of said ring extending circumferentially about said cover over an outer margin of the cover, and an outer margin of said ring extending over a gap formed between said opening and said pan, said ring further having an upper section whose height corresponds to a height the sidewall of said insulation material extends above said rim and a lower section fitting about said insulation material sidewall.

23. The replacement radiant heating unit of claim 22 wherein said radiant heating element is a coil type heating element.

24. The replacement radiant heating unit of claim 22 wherein said radiant unit is a ribbon type heating element.

* * * * *